United States Patent [19]

Ohyatsu et al.

[11] Patent Number: 4,651,757

[45] Date of Patent: Mar. 24, 1987

[54] METHOD AND APPARATUS FOR RELEASING CUT TOBACCO FROM CIGARETTE

[75] Inventors: Shin Ohyatsu, Hiratsuka; Keisuke Minami, Hadano, both of Japan

[73] Assignee: The Japan Tobacco & Salt Public Corporation, Tokyo, Japan

[21] Appl. No.: 682,928

[22] Filed: Dec. 18, 1984

[30] Foreign Application Priority Data

Dec. 26, 1983 [JP] Japan ..... 58-243774

[51] Int. Cl.[4] ..... A24C 5/36

[52] U.S. Cl. ..... 131/96; 241/275; 241/154

[58] Field of Search ..... 131/96; 209/3, 287; 241/275, 154

[56] References Cited

U.S. PATENT DOCUMENTS

| | | | |
|---|---|---|---|
| 2,818,985 | 1/1958 | Irmscher . | |
| 3,577,998 | 5/1971 | Pinkham . | |
| 3,577,999 | 5/1971 | Pinkham | 131/96 |
| 4,151,794 | 5/1979 | Burkett | 241/154 |
| 4,278,100 | 7/1981 | Thatcher | 131/96 |
| 4,326,676 | 4/1982 | Rose | 241/275 |
| 4,493,459 | 1/1985 | Burkett | 241/154 |

*Primary Examiner*—V. Millin
*Assistant Examiner*—H. Macey
*Attorney, Agent, or Firm*—Balogh, Osann, Kramer, Dvorak, Genova & Traub

[57] ABSTRACT

A method and apparatus for releasing cut tobacco from cigarettes are disclosed. The method includes the steps of providing dispersing fans at its periphery in a radial manner within a releasing barrel, scattering the cigarettes by the dispersing fans, circulating the scattered cigarettes along several releasing plates adjacently arranged to form a circle around the outer periphery of the dispersing disc, and releasing part of cut tobacco from the cigarettes by colliding it against knobs which are arranged at the inner peripheral surface of each of the releasing plates during circulation. Such rotary dispersing discs as mentioned above are formed in several steps in the vertical direction within the releasing barrel. The partly released cigarettes are dropped on to the lower step of the rotary dispersing disc through openings defined between adjacent releasing plates. The cut tobacco is separted from the roll paper or filter by a vibrating screen after repeating the above mentioned steps on the lower rotary dispersing discs.

12 Claims, 4 Drawing Figures

METHOD AND APPARATUS FOR RELEASING CUT TOBACCO FROM CIGARETTE

BACKGROUND OF THE INVENTION

The present invention relates to a method and apparatus for releasing and separating cut tobacco from double cut cigarettes, filter-tip cigarettes, mouthpiece-tip cigarettes, or uncutting cigarettes, particularly such cigarettes, as rejected in the inspecting process, cigarettes produced while the machine being adjusted and uncutting cigarettes produced at one stage of the manufacturing process, etc. (hereinafter, these cigarettes will be referred to simply as cigarettes).

In general, it is an extremely important subject to release and separate cut tobacco from such cigarettes in order to recover the cut tobacco for reuse purposes in view of an effective use of expensive raw material of tobacco.

Heretofore, conventional apparatus serving for the above purpose are known as disclosed in the specifications of Japanese patent publication Nos. 43(1968)-23982 and 46(1971)-5040.

That is, the apparatus disclosed in the former publication is of the type wherein cigarettes irregularly fed are arranged in the vertical direction. After transferring the cigarettes through a wet belt conveyor for wetting a part thereof, the cigarettes are pressurized to break the wet portion. Then, the cut tobacco is separated from others by using vibrating screen. Likewise, the apparatus disclosed in the latter publication is of the type wherein a plurality of fixed fans are arranged within a vertical cylindrical barrel, and a plurality of rotary fans are mounted on a rotary shaft disposed in the central portion in an alternative manner with respect to said fixed fans. While the cigarette drops through the fixed fans as well as the rotary fans, the cut tobacco is separated from the other parts of cigarettes.

However, although these apparatus are suitable for separating the cut tobacco from cigarettes which are already cut as short as to about 10 cm or so, when the cut tobacco is to be separated from such long cigarettes as having a length of about 1 m generally called as a "rod roll" which tends to refuse to pass through the cutting portion of a winding machine, or from double length cigarettes having filter means at the central portion thereof, the recovering efficiency proves to be extremely poor. Moreover, it is difficult for the former publication apparatus to treat a large amount of cigarettes. In addition, the recovered cut tobacco is changeable in quality due to wet, and the separation efficiency of the cut tobacco is decreased since the roll paper and filter are broken into cotton shape. Similarly, in the case of the apparatus disclosed in the latter publication, the apparatus becomes large in size and the separation performance is not necessarily satisfactory.

The present invention is accomplished in view of the above disadvantages.

SUMMARY OF THE INVENTION

It is therefore an object of the present invention to provide a method and apparatus for releasing cut tobacco from cigarette wherein cut tobacco can be released from cigarettes of any shapes as mentioned above with excellent separation efficiency.

Another object of the invention is to provide a method and apparatus for releasing cut tobacco from cigarettes wherein a mass treatment can be achieved using a small sized apparatus.

A further object of the invention is to provide a method and apparatus for releasing cut tobacco from cigarettes wherein separating and releasing operations of cut tobacco from cigarettes are carried out in a gradual manner so that excessive crushing can be avoided with respect to cigarettes, roll paper, filter fiber, etc.

A still further object of the invention is to provide a method and apparatus for releasing cut tobacco from cigarette wherein extremely high recovering percentage of cut tobacco can be achieved with respect to inferior cigarette by regulating the mingling of roll paper, filter etc. into cut tobacco.

In order to achieve the above objects and others there is essentially provided a method for releasing cut tobacco from cigarettes comprising feeding cigarettes to the uppermost step of rotary dispersing disc among discs arranged in a plurality of steps in the vertical direction within a releasing barrel and provided with dispersing fans at the peripheries thereof in a radial manner; scattering said cigarettes by the shock of said dispersing fans; circulating the scattered cigarettes along a plurality of releasing plates arranged in an adjacent manner relative to each other to form a circle around the outer periphery of each of said dispersing discs, the terminal end portions of the releasing plates being spreaded outward along the rotating direction of said dispersing disc with respect to the starting end portions thereof; releasing a part of cut tobacco from said cigarettes by colliding the latter against knobs arranged at the inner peripheral surface of each of said releasing plates during circulation; dropping said partly released cigarettes on to the lower step of rotary dispersing disc through openings defined by the starting end portions and the terminal portions of said adjacent releasing plates; and separating the cut tobacco from the roll paper or filter by separating means such as a vibrating screen after repeating the above mentioned means for separating the cut tobacco from the cigarettes on the lower steps of rotary dispersing discs.

There is also provided an apparatus for releasing cut tobacco from cigarettes comprising a releasing barrel having a feed hopper at its upper portion; a rotary shaft vertically disposed within said releasing barrel through the central portion thereof and rotatably supported at its both ends by bearings; dispersing discs arranged in a plurality of steps around said rotary shaft, each of said dispersing discs being provided with a plurality of separating fans erected upright in a radial manner; a plurality of releasing plates arranged in an adjacent manner relative to each other to form a circle around the outer periphery of each of said dispersing discs, the starting end portions of said releasing plates being spreaded outward with respect to the terminal end portions thereof, said releasing plates having a number of knobs projected in the perpendicular direction with respect to the inner peripheral surfaces thereof; and chutes each arranged above each of said dispersing discs, said chute having a slant surface facing toward the central portion of said dispersing disc.

DETAILED DESCRIPTION OF THE EMBODIMENT

The present invention will be described in detail hereunder with reference to the accompanying drawings illustrating an embodiment thereof.

Figure 1:
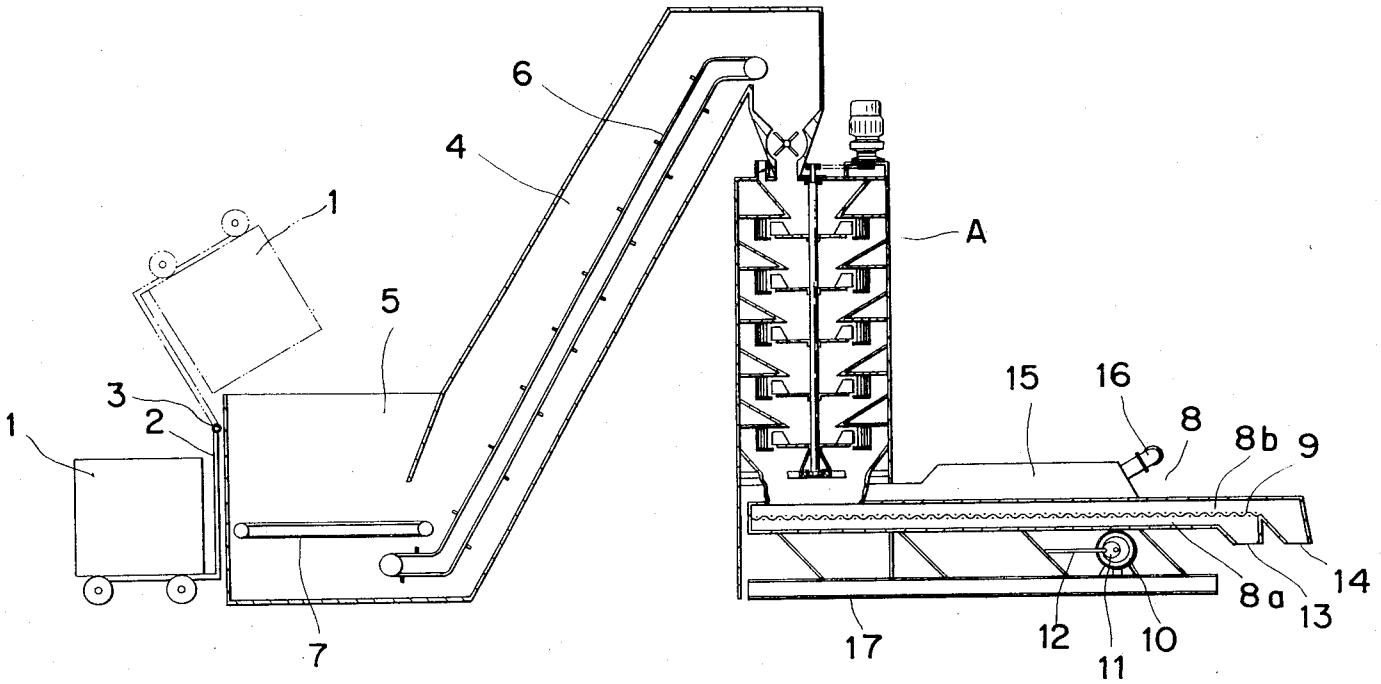
FIG. 1 is a schematic view showing the whole picture of apparatus in order to practise the present invention.

FIG. 1 is a schematic view showing the whole picture of apparatus required for practising the present invention.

In the drawing, 1 designates a carrier for cigarette to be treated. 2 designates a device for turning upside down said carrier 1 around a shaft 3 as a supporting point. 4 designates a feeding portion of cigarette, the lower portion of which is connected to a hopper 5. Within said supporting portion 4, a scraping-up belt 6 is disposed. Said hopper 5 is arranged at its bottom portion with a conveyor belt 7. A designates an apparatus according to the present invention as will be described in detail later. A hopper of the invented apparatus A is connected to the upper portion of said feeding portion 4. Cigarette is fed into this hopper from the upper portion of the feeding portion 4. The mixture of cut tobacco, roll paper, filter, etc. of cigarette which were treated by the apparatus A by means of a method as will be described is naturally dropped on to a separating portion 8 connected to the lower portion of the apparatus A. Within the separating portion 8 disposed in an extending manner is a vibrating screen 9 for moving to and for by an electric motor 10 through an eccentric rod 11 and a shaft 12. The cut tobacco, roll paper, filter, etc. are separated by the vibrating screen 9. The end portion of the vibrating screen 9 is provided with an outlet port 13 for allowing cut tobacco to be taken out therefrom and another outlet port 14 for allowing roll paper, filter, etc. to be taken out therefrom, said ports 13 and 14 being communicated into lower and upper ducts 8*a* and 8*b* of the screen 9, respectively. 15 designates a dust preventing hood formed at the upper portion of the screen 9 of the separating portion 8. 16 designates a dust preventing duct and 17 designates a base supporting the vibrating screen 9 as well as the electric motor 10 of the separating portion 8.

Figure 2:
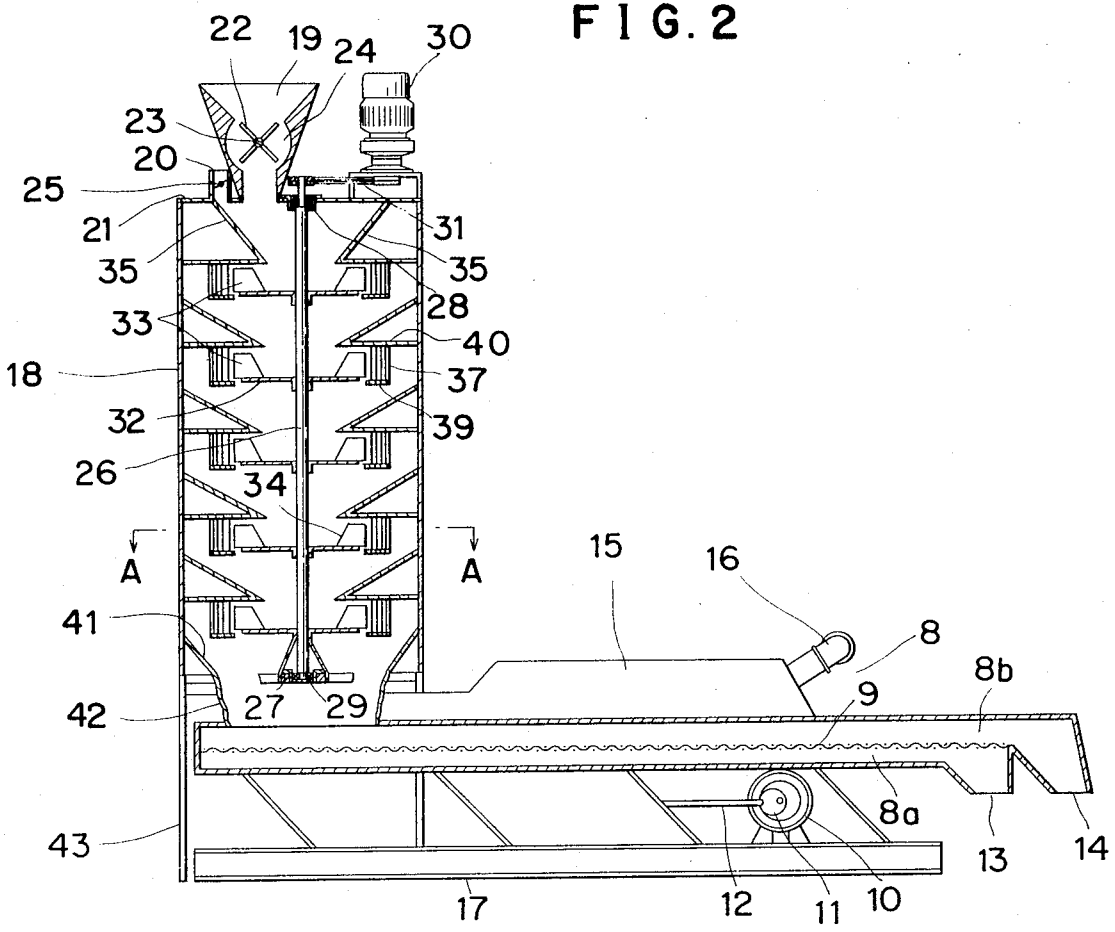
FIG. 2 is a schematic vertical sectional view showing a cut tobacco relesing apparatus of the present invention.
Figure 3:
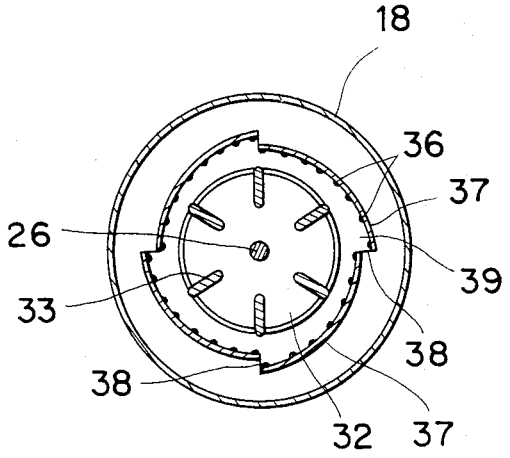
FIG. 3 is a section taken on the line A—A of FIG. 2.

FIG. 2 schematically illustrates a vertical section view of a cut tobacco releasing apparatus A according to the present invention and FIG. 3 illustrates a section taken on the line A—A of FIG. 2.

In the drawings, 18 designates a releasing barrel formed in the shape of a vertical cylinder. The upper portion of said releasing barrel 18 is blocked with a top board excepting the openings of a feed hopper 19 and an air intake conduit 20. Within said feed hopper 19, an air locker 24 is disposed. Said air locker 24 is constituted with a plurality of rotary fans 22 arranged around a shaft 23. Said fans are rotated within a cylindrical barrel in such a manner as to contact the inner wall thereof by means of a rotating mechanism (not shown), said cylindrical barrel being opened at its upper and lower portions. Likewise, within the air intake conduit 20, a damper 25 is disposed in such a manner as to be rotated by means of a manually operated lever or the like (not shown).

A rotary shaft 26 is carried in the vertical direction by bearings 28 and 29 fixed to the top board 21 as well as by a lower supporting frame 27 and is variably rotated by means of a multiple speed-variable electric motor mounted on the top board 21 through a pulley 31 and the bearings 28 and 29.

A plurality of dispersing discs (6 pieces in the illustrated embodiment) are suitably spacedly mounted to the rotary shaft 26. Each of said respective dispersing discs 32 is arranged at its perimeter with a plurality of dispersing fans 33 (6 pieces in the illustrated embodiment) erected upright in a radial manner. The dispersing fan 33 is formed in a square, plate-shaped body with its one side formed in taper and mounted in the radial direction of the dispersing disc 32 in such a manner as to be slightly changable of its mounting position by screw means or the like. Preferably, normally from 3 to 6 pieces of dispersing fans 33 are mounted on the dispersing disc 32. Also, the number of the mounting fans 33 may be changed between the upper step and the lower step in such a manner as to decrease the number thereof as it goes to the lower dispersing discs 32.

Figure 4:
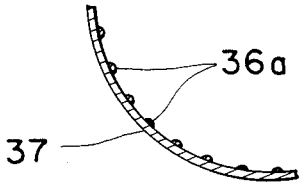
FIG. 4 is a partly plan view showing another embodiment of a releasing plate of the present invention.

A chute 35 is fixedly secured to the inner peripheral surface of the releasing barrel 18 above the perimeter of each of the dispersing discs 32, said chute 35 having a slant face declining from the inner peripheral surface of the releasing barrel 18 toward the centeral portion of the dispersing disc 32. Also, at the outer periphery of each of the dispersing discs 32, a plurality of releasing plates 37 are arranged in an adjacent manner relative to each other to form a circle in such a manner as that the terminal end portions of the releasing plates 37 are spread outward along the rotating direction (the direction shown by an arrow in FIG. 3) of the dispersing disc 32 with respect to the starting end portions thereof. A number of knobs 36 are firmly secured to said releasing plates 37 at the outer peripheries in the vertical direction of the inner peripheries. The gap between the adjacent starting end portion and the terminal end portion of each of said releasing plates 37 is defined as an opening 38. Although 4 pieces of releasing plates 37 are shown in the illustrated embodiment, they may be arranged from 2 to 6, or more in number. Also, the distance between the perimeter of the dispersing disc 32 and the releasing plate 37 varies with respect to the starting end portion and the terminal end portion of the releasing plate 37. However, preferably, it should be about 25 cm on average and the width of said opening portion 38 should be about 20 cm. Similarly, from a manufacturing point of view, it is preferable to use round rods having from about 6 to 18 mm in diameter as the knobs 36 arranged at the inner peripheral surface of the releasing plate 37. Alternatively, as shown in the partly plan view of the dispersing plate 37 in FIG. 4, the knobs 36*a* may be of half-annular shapes in section, or other desirable shapes. However, it is preferable to form the surfaces of the knobs 36 and 36*a* in a round shape in order to prevent excessive crushing of the treating material. Usually, the mounting distances between these knobs 36 and 36*a* are from 10 to 50 mm, respectively.

Said releasing plates 37 are disposed between an annular plate 39 annularly arranged in the close vicinity of the perimeter of the dispersing disc 32 and a frame 40 adapted to support the chute 35 and firmly secured thereto by clamping means or the like.

The dispersing discs 32, releasing plates, chutes 35, etc. constituted as mentioned above are substantially equally spacedly mounted on the rotary shaft 26 and in a plurality of steps, for example, from 3 to 6 steps. As the number of steps of the dispersing discs is increased, there is a tendency that the crushing percentage of cut tobacco and the mingling percentage of roll paper and filter into the cut tobacco is slightly increased. On the other hand, there is seen a tendency that the recovering percentage of the cut tobacco is increased considerably.

41 designates an outlet chute provided at the lower inner periphery of the releasing barrel 18 and beneath the lowest step of dispersing disc 32. 42 disignates a seal continuously formed from the outlet chute 41 to the separating portion 8, and 43 is a supporting column supporting the releasing barrel 18.

Nextly, the function of the cut tobacco releasing apparatus of the present invention which is constituted as in the foregoing manner will be described.

The afore-mentioned inferior cigarette is fed into the feed hopper 19 from the upper portion of the scraping-up belt 6 of the feeding portion 4 as shown in FIG. 1. Then, while being regulated the feeding amount by the rotary fan 22 of the air locker 24, the cigarette is dropped on to the central portion of the uppermost step of dispersing disc 32 through the chute 35. The dispersing disc 32 is rotated at from 400 to 800 r.p.m. by the electric motor 30 through the rotary shaft 26. As the rotating speed of the dispersing disc 32 is increased, the recovering percentage of cut tobacco is increased. On the other hand, there is seen a tendency that the crushing percentage of cut tobacco is also increased. Furthermore, the suitable rotating speed varies depending on the number of the steps of the dispersing discs mounted on the rotary shaft 26. For example, in the case the number of the step is 6, a favorable result is obtained in the range of from 500 to 600 r.p.m.

The cigarette which is dropped on to the central portion of the dispersing disc 32 is dispersed by the rotation of the dispersing fan 33. While being circulated along the dispersing plate 37, the cigarette is caused to collide against the knobs of the dispersing plate 37 thereby separating and releasing the cut tobacco from the roll paper and filter. The cigarette from which the cut tobacco is partly released in this process is discharged outward of the releasing plate 37 through the opening portion 38 thereof. While being circulated around the inner peripheral wall of the releasing barrel 18 and the surface of the chute 35, the same is dropped on to the central portion of the lower step of dispersing disc 32. While the similar function as mentioned in the foregoing is repeated until the same reaches the lowest step of dispersing disc 32, the cut tobacco is almost completely separated and released from the roll paper and filter.

The circulating motion of the cigarette within the releasing barrel 18 is freely adjustable not only by adjusting the rotating speed of the dispersing disc 32, but also by varying the opening degree of the damper 25 of the air intake conduit 20 for adjusting the air introducing amount.

The cut tobacco separated and released from the cigarette is dropped in the separating portions 8 in the mixed state with roll paper pieces and filter pieces through the lower chute 41, and separated into cut tobacco, and roll paper pieces and filter pieces by the vibrating screen 9. The separated cut tobacco is taken out from the outlet port 13, and the roll paper pieces and filter pieces are taken out from the other outlet port 14, respectively.

In the above illustrated embodiment, although the respective dispersing discs 32 are arranged in a plurality of steps in the vertical direction within one releasing barrel 18, the releasing barrel 18 may be divided into a plurality of units for installing side by side so that the treating material dropped on to the lower portion of the preceeding releasing barrel may be fed to the upper portion of the subsequent releasing barrel. It will be understood that many other modifications and alternations may be made without departing from the spirit of the present invention.

Since the present invention is embodied by such a method and apparatus as described in detail in the foregoing, the separating and releasing function of the cut tobacco from cigarettes is carried out gradually, thereby preventing excessive crushing of cut tobacco, roll paper, filter fiber, etc. and enabling to limit the mingling percentage of roll paper and filter into the cut tobacco to the least degree. As a result, an extremely high result of the recovering percentage as from 95 to 99% is obtained. Moreover, according to the invented apparatus, a smooth separation and release can be made even for so-called rod-roll and double length cigarettes which are low in recovering percentage according to the conventional art. Also, the invention is suitable for mass treatment of cigarettes.

What is claimed is:

1. A method for releasing cut tobacco from cigarettes comprising:

feeding cigarettes to dispersing discs vertically arranged in a plurality of stages within a releasing barrel and provided with dispersing fans adjacent the peripheries of said discs;

scattering said cigarettes by said dispersing fans;

circulating the scattered cigarettes along a plurality of curved releasing plates arranged in the stages in an adjacent manner relative to the respective peripheries of said dispensing discs to form a circle around the outer periphery of each of said dispersing discs, end portions of the releasing plates being radially spread apart to define openings;

releasing part of cut tobacco from said cigarettes by colliding the cigarettes against knobs arranged at inner peripheral surface of each of said curved releasing plates during circulation;

dropping said partly released cigarettes on to the rotary dispersing disc in next lower stage through said openings; and separating the cut tobacco from the roll paper and filter by separating means after repeating the above-mentioned steps for separating the cut tobacco from the cigarettes on the lower stages of rotary dispersing discs.

2. A method for releasing cut tobacco from cigarettes according to claim 1, wherein said cigarettes are filter-tip cigarettes.

3. A method for releasing cut tobacco from cigarettes according to claim 1, wherein said cigarettes are mouthpiece-tip cigarettes.

4. A method for releasing cut tobacco from cigarettes according to claim 1, wherein said cigarettes are uncut cigarettes such as those rejected in the inspecting process.

5. A method for releasing cut tobacco from cigarettes according to claim 1, wherein said separating step is achieved with a vibrating screen.

6. A method for releasing cut tobacco from cigarettes according to claim 1, wherein said dispersing discs are rotated at from 400 to 800 r.p.m.

7. An apparatus for releasing cut tobacco from cigarettes comprising:

a releasing barrel having a feed hopper at its upper portion;

a rotary shaft vertically disposed within said releasing barrel through the central portion thereof and rotatably supported at its both ends by bearings;

dispersing discs vertically arranged in a plurality of stages, one above the other, each of said dispersing discs being provided with a plurality of separating fans errected upright in a radial manner;

a plurality of curved releasing plates arranged in each stage and in an adjacent manner relative to respective discs to form an enclosure around the outer periphery of each of said dispersing discs, end portions of said releasing plates being spread radially outward with respect to each other to define therebetween openings, said releasing plates having a number of knobs projected in perpendicular direction with respect to inner peripheral surfaces of said curved releasing plate; and chutes, each arranged above each of said dispersing discs, each chute having a slant surface facing toward the central portion of said dispersing disc.

8. An apparatus for releasing cut tobacco from cigarettes according to claim 7, wherein said hopper includes an air locker.

9. An apparatus for releasing cut tobacco from cigarettes according to claim 7, wherein each of said dispersing fans is of a square plate shape having its inner side tapered.

10. An apparatus for releasing cut tobacco from cigarettes according to claim 7, wherein each of said knobs is a round rod having a diameter of from about 6 to 18 mm.

11. An apparatus for releasing cut tobacco from cigarettes according to claim 7, wherein each of said knobs has a half-circular shape in cross-section.

12. An apparatus for releasing cut tobacco from cigarettes according to claim 7, wherein each of said knobs has a round surface.

* * * * *